US005310718A

United States Patent [19]

Amano et al.

[11] Patent Number: 5,310,718

[45] Date of Patent: May 10, 1994

[54] METHOD OF COMPENSATING FOR DISTORTION IN RECORDING LAYER IN REVERSIBLE THERMOSENSITIVE RECORDING MEDIUM

[75] Inventors: Tetsuya Amano, Numazu; Makoto Kawaguchi, Shizuoka; Yoshihiko Hotta, Mishima; Atsushi Kutami; Kunichika Morohoshi, both of Numazu; Akihide Ito; Fumihito Masubuchi, both of Mishima; Takao Igawa, Numazu; Tsutomu Kagawa, Shizuoka; Nobuo Yamada; Katsuyoshi Kodama, both of Numazu, all of Japan

[73] Assignee: Ricoh Company, Ltd., Tokyo, Japan

[21] Appl. No.: 992,744

[22] Filed: Dec. 18, 1992

[30] Foreign Application Priority Data

| | | | |
|---|---|---|---|
| Dec. 20, 1991 | [JP] | Japan | 3-355081 |
| Mar. 18, 1992 | [JP] | Japan | 4-093912 |
| Mar. 18, 1992 | [JP] | Japan | 4-093913 |
| Mar. 26, 1992 | [JP] | Japan | 4-100725 |
| Jun. 30, 1992 | [JP] | Japan | 4-196074 |

[51] Int. Cl.[5] ..... B41M 5/36

[52] U.S. Cl. ..... 503/201; 503/217

[58] Field of Search ..... 428/913; 503/201, 202, 503/204, 218, 221, 226, 217

[56] References Cited

U.S. PATENT DOCUMENTS 4,602,263 7/1986 Borror et al. ..... 428/913

*Primary Examiner*—Pamela R. Schwartz

*Attorney, Agent, or Firm*—Oblon, Spivak, McClelland, Maier & Neustadt

[57] ABSTRACT

A method of compensating for the distortion in a recording layer of a reversible thermosensitive recording medium, for which transparency of the recording layer is changeable, depending upon the temperature thereof, and the recording layer is capable of forming images and erasing the images reversibly. The distortion in the recording layer is caused by the repeated image formation by image formation means and/or image erasure by image erasing means. In this method, stress is applied to the recording layer before and/or after image formation by the movement of the recording medium relative to the image formation means, in a direction different from the direction of the application of stress in the course of a previous image formation or image erasure. Instead of the stress, thermal energy can be employed for compensating for the distortion in the recording layer.

14 Claims, 11 Drawing Sheets

FIG. 7(m) 1st: I.F. N.C.H.A. I.E. + ···

FIG. 7(n) 1st: I.F. C.H.A. I.E. + ···

FIG. 7(o) 1st: I.F. C.H.A. I.E.

FIG. 7(p) 1st: I.F. C.H.A. I.E.

FIG. 7(q) 1st: I.F. N.C.H.A. I.E. (N.C.E)

METHOD OF COMPENSATING FOR DISTORTION IN RECORDING LAYER IN REVERSIBLE THERMOSENSITIVE RECORDING MEDIUM

BACKGROUND OF THE INVENTION

1. Field of the Invention

The present invention relates to a method for compensating for the distortion in a recording layer of a reversible thermosensitive recording medium which comprises a substrate and a recording layer whose transparency changes depending upon the temperature of the recording layer. The distortion in the recording layer is caused while images are repeatedly formed by image formation means and/or while formed images are erased by image erasing means.

2. Discussion of Background

Recently attention has been paid to a reversible thermosensitive recording medium capable of temporarily recording images thereon and erasing the same therefrom when such images become unnecessary. As representative examples of this kind of reversible thermosensitive recording medium, there are conventionally known reversible thermosensitive recording media comprising a substrate and a recording layer in which an organic low-molecular-weight material such as a higher fatty acid is dispersed in a matrix resin such as vinyl chloride - vinyl acetate copolymer with a low glass transition temperature (Tg) of 50° C. to less than 80° C., as disclosed in Japanese Laid-Open Patent Applications 54-119377 and 55-154198.

These thermosensitive recording media, however, have the shortcomings that the recording layer is distorted and is caused to deteriorate while images are formed or erased repeatedly by a heating element such as a thermal head, so that image density and image contrast are significantly decreased while in use. This problem has not yet been dissolved.

SUMMARY OF THE INVENTION

It is therefore an object of the present invention to provide a method for compensating for the distortion in a recording layer of a reversible thermosensitive recording medium which comprises a substrate and a recording layer whose transparency changes depending upon the temperature of the recording layer, whereby the distortion in the recording layer is compensated for, and the deterioration of the recording layer is prevented to maintain image density and image contrast high.

This object of the present invention is attained by a method of compensating for the distortion in the recording layer of the reversible thermosensitive recording medium, comprising the step of applying stress to the recording layer before and/or after image formation by moving the recording medium relative to the image formation means, in a direction different from the direction of the application of stress in the course of a previous image formation or image erasure, thereby compensating for the distortion.

The above object of the present invention can also be attained as follows:

In the above-mentioned method, the stress applied to the recording layer for compensating for the distortion therein is applied by a pressure application means, and at the same time, the recording medium is moved in a direction opposite to the direction in which the recording medium is transported at the image formation.

The image erasing means can be modified so as to serve as the pressure application means.

The image formation means and the image erasing means can be modified to one and the same means which also serves as the pressure application means.

The image formation means and the image erasing means can be modified so as to separately serve as pressure application means for applying pressure to the recording layer of the recording medium.

The pressure application means can also be modified so as to have a heat application function and apply heat to the recording layer of the recording medium during the application of pressure to the recording layer.

The pressure application means may apply pressure to the recording layer of the recording medium between the repetition of image formation and/or image erasure.

The pressure application means may apply the stress by the application of a pressure of about 0.1 kg/cm$^2$ or more.

The above-mentioned object of the present invention can be also be attained by a method of compensating for the distortion in the recording layer of the reversible thermosensitive recording medium, comprising the step of applying heat to the recording layer by a non-contact heat application means before and/or after image formation by moving the recording medium relative to the image formation means.

In the above-mentioned method, the non-contact heat application means may serve as the image erasing means.

It is preferable that the duration of heat application by the non-contact heat application means is not less than about 0.2 seconds.

Furthermore, the object of the present invention can be attained by a method of compensating for the distortion in the recording layer of the reversible thermosensitive recording medium, comprising the step of changing the transporting direction of the recording medium before and/or after image formation by moving the recording medium relative to the image formation means, thereby compensating for the distortion.

In the above method, the changing of the transporting direction of the recording medium may be conducted during the formation of one picture element in the image formation.

The changing of the transporting direction of the recording medium relative to the image formation means may be conducted intermittently, and energy application can be carried out by printing pulses during the movement of the recording medium.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 2(*d*) is a schematic illustration of examples of the stress application directions for compensating the distortion in the recording layer of the reversible thermosensitive recording medium.

FIG. 4(*b*) is a schematic illustration of a contact pressure and heat application type image erasing unit for use in the present invention.

FIG. 4(*c*) is a schematic illustration of a non-contact heat application type image erasing unit for use in the present invention.

FIG. 4(*d*) is a schematic illustration of a contact pressure and heat application type image erasing unit for use in the present invention.

DETAILED DESCRIPTION OF THE PREFERRED EMBODIMENTS

Figure 1A:
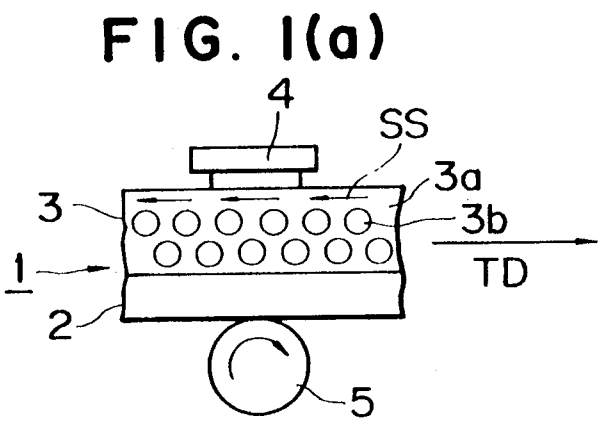
FIG. 1(*a*) to FIG. 1(*d*) are schematic illustrations of the mechanism of the formation of the distortion in a recording layer of a reversible thermosensitive recording medium during the image formation by a conventional method.
Figure 1B:
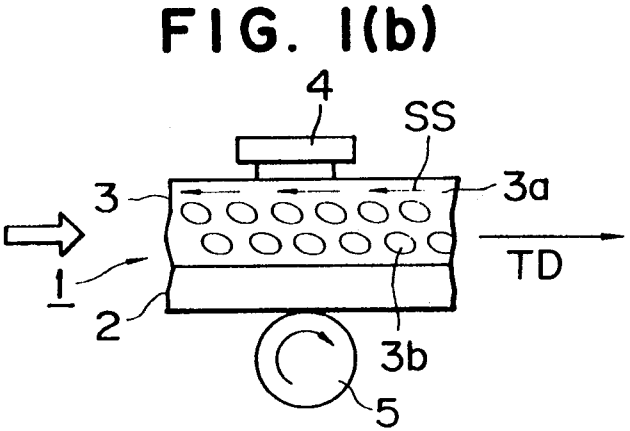
Figure 1C:
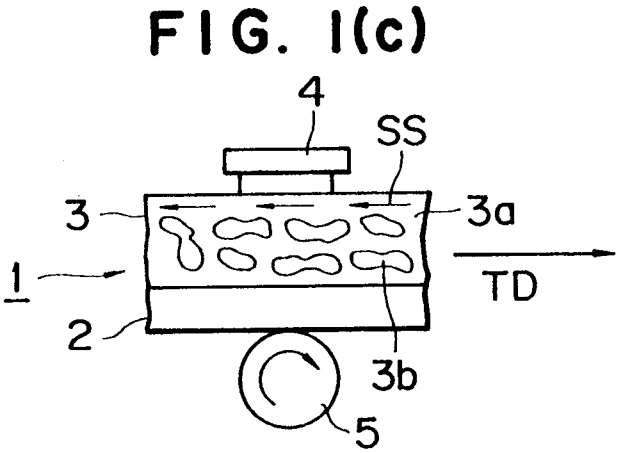
Figure 1D:
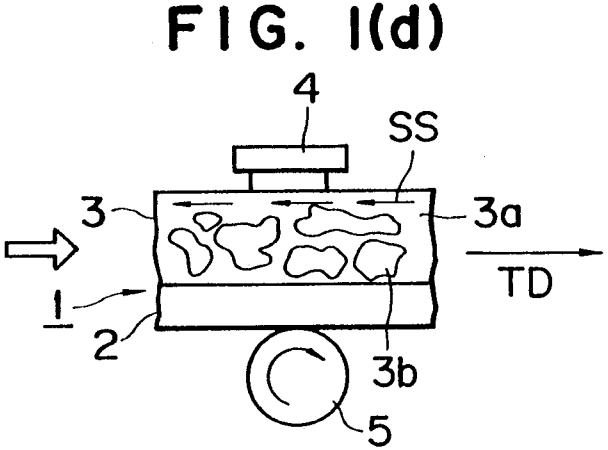
Figure 2A:
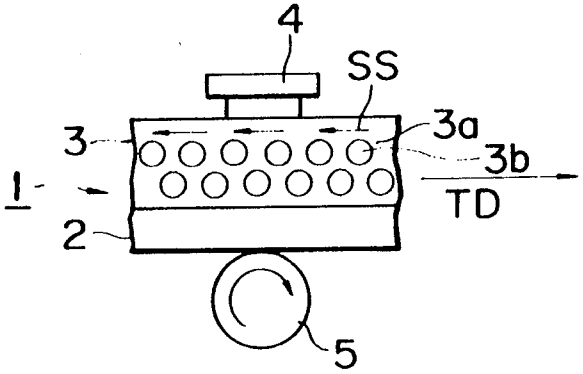
FIG. 2(*a*) to FIG. 2(*c*) ar schematic illustrations of the compensation of the distortion in the recording layer of the reversible thermosensitive recording medium by the method of the present invention.
Figure 2B:
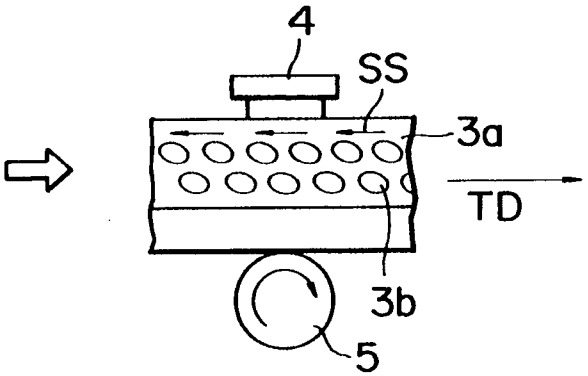
Figure 2C:
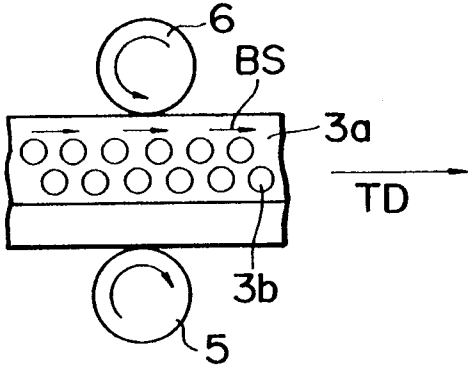
Figure 2D:
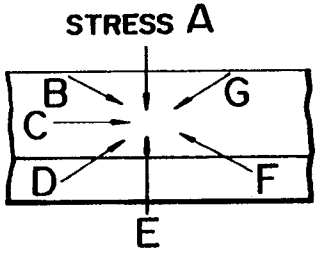

The inventors of the present invention have investigated the mechanism of the deterioration of the recording layer of a reversible thermosensitive recording medium comprising a recording layer which comprises an organic low-molecular-weight material and a resin matrix in which the organic low-molecular-weight material is dispersed. The deterioration causes the decrease of the image density when image formation and image erasure are repeatedly conducted in As a result, it has been found that when image information is not repeated many times, by no distortion is caused in the recording layer, even when a heating element such as a thermal head which is in pressure contact with the surface of the recording medium is employed, so that the dispersion state of the organic low-molecular-weight material in the resin matrix is not changed. To be more specific, in this case, the organic low-molecular-weight material is uniformly dispersed in the resin matrix.

FIG. 1(*a*) shows the above-mentioned state. In the figure, reference numeral 1 indicates a reversible thermosensitive recording medium which comprises a substrate 2, which is made of, for example, a polyethylene terephthalate (PET) film, and a recording layer 3. The recording layer 3 comprises a matrix resin 3*a* and an organic low-molecular-weight material 3*b*, which is in the form of particles and is dispersed uniformly in the matrix resin 3*a*.

A heating element 4, such as a thermal head, is set in contact with the surface of the recording layer 3 and the reversible thermosensitive recording medium 1 is moved relative to the heating element 4 in the direction TD as shown by the arrow. Reference numeral 5 indicates a platen roller which is rotated in the direction of the arrow in contact with the substrate 2.

In the course of an image formation process, with the application of thermal energy by the heating element 4 to the recording layer 3, shearing stress SS is exerted within the recording layer 3 in the direction of the arrows as shown in FIG. 1(*a*).

When the image recording process is repeated, a distortion is generated within the recording layer 3 mainly by the above-mentioned shearing stress SS, so that the particles of the organic low-molecular-weight material 3*b* are deformed as illustrated in FIG. 1(*b*).

When the image formation process is further repeated, the deformed particles of the organic low-molecular-weight material 3*b* begin to aggregate as illustrated in FIG. 1(*c*). Finally the aggregation of the deformed particles of the organic low-molecular-weight material 3*b* proceeds so that the particle size of the aggregated organic low-molecular-weight material 3*b* is maximized as illustrated in FIG. 1(*d*).

It is considered that the deterioration of the image density and contrast during the repeated image formation and image erasing is caused by such aggregation of the organic low-molecular-weight material 3*b*, which is caused by the distortion in the recording layer 3.

The inventors of the present invention have discovered that the above-mentioned distortion in the recording layer 3 can be compensated for even when image recording is started from the state of the recording layer 3 as illustrated in FIG. 2(*a*), in which the particles of the organic low-molecular-weight material 3*b* are uniformly dispersed within the matrix resin 3*a*, and the particles of the organic low-molecular-weight material 3*b* are deformed by the shearing stress SS during the successive image formation as illustrated in FIG. 2(*b*), if a back stress BS is applied in the direction different from the direction of the first applied shearing stress SS by back stress application means 6 as shown in FIG. 2(*c*).

When such back stress is applied in the direction different from that of the shearing SS to the recording layer 3, the distortion in the recording layer 3 is compensated for, so that the deformed particles of the organic low-molecular-weight material 3*b* return to their original shape, and the aggregation of the particles of the organic low-molecular-weight material 3*b* is prevented. The result is that the obtained image density and image contrast can be maintained high even when the image formation and image erasing are repeated.

In FIG. 2(*c*), the direction of the back stress is illustrated by the arrows which are opposite to the direction of the shearing stress SS for the convenience of the explanation. However, as illustrated in FIG. 2(*d*), stresses A, B, C, D, E and F are also effective as such back stress. Of these stresses, stresses A through E are more effective than the other stresses, and stresses D through D are most effective.

The reversible thermosensitive recording medium for use in the present invention reversibly changes its color tone to a visible degree depending on its temperature. The changes in the color toner are caused by the changes, for instance, in transmittance, reflectivity, absorption wavelength, and scattering degree of the reversible thermosensitive recording medium depending upon the temperature thereof. Image formation or display by the reversible thermosensitive recording medium is carried out by the combination of the changes in the above-mentioned properties. More specifically, there are the following two types of reversible thermosensitive recording media that can be employed in the present invention:

(A) Reversible thermosensitive recording medium which reversibly changes the transparency of the recording layer from a transparent state to a milky-white opaque state, and vice versa; and (B) Reversible thermosensitive recording medium which reversibly changes the color of a dye contained in the recording layer.

A representative example of the above type (A) includes a recording layer which comprises a matrix resin such as polyester, and an organic low-molecular-weight material such as higher alcohols, or higher fatty acids, which is dispersed in the matrix resin. A representative example of the above type (B) employs conventional leuco dyes with the reversibility of color being intensified (refer to Japan Hardcopy '90 Theses, p147, by Yoshihiro HINO et al.).

The present invention will now be explained with reference to the above-mentioned (A) type reversible thermosensitive recording medium.

The reversible thermosensitive recording medium for use in the present invention utilizes the properties that can be switched from a transparent state to a milky white opaque state, and vice versa, depending on the temperature thereof. The difference between the transparent state and the milky white opaque state of the recording medium is considered to be based on the following principle:

(i) In the transparent state, the organic low-molecular-weight material dispersed in the matrix resin is composed of relatively large crystals, so that the light which enters the crystals from one side passes therethrough to the opposite side, without being scattered, thus the reversible thermosensitive recording medium appears transparent.

(ii) In the milky white opaque state, the organic low-molecular-weight material is composed of polycrystals consisting of numerous small crystals, with the crystallographic axes directed in various directions, so that the light which enters the recording layer is scattered a number of times at the interfaces of the crystals of the low-molecular-weight material. As a result, the recording layer becomes opaque in a milky white color.

The transition of the state of the recording layer depending on the temperature thereof will now be explained by referring to FIG. 3.

Figure 3:
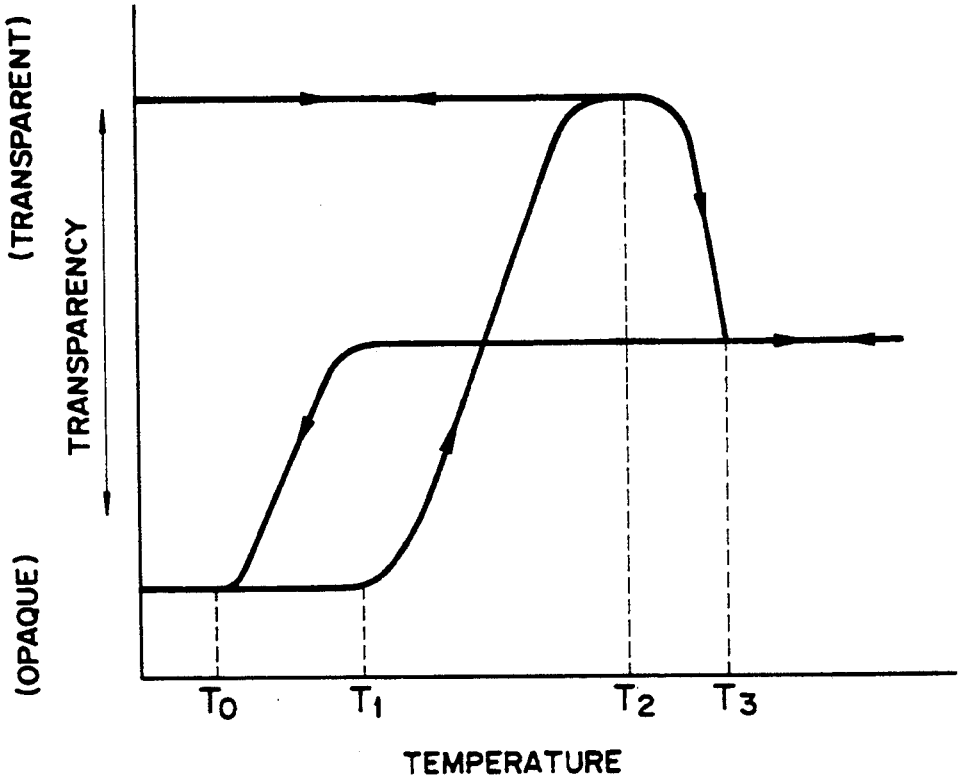
FIG. 3 is a schematic diagram showing the changes of the transparency of a reversible thermosensitive recording medium, which depend on the temperature thereof, for use in the present invention.
Figure 4A:
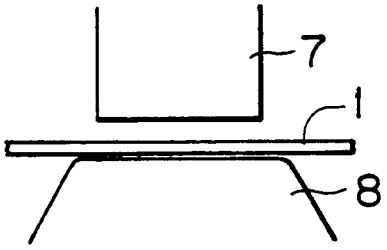
FIG. 4(*a*) is a schematic illustration of a contact pressure and heat application type image erasing unit for for use in the present invention.
Figure 4B:
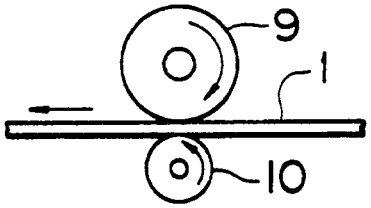
Figure 4C:
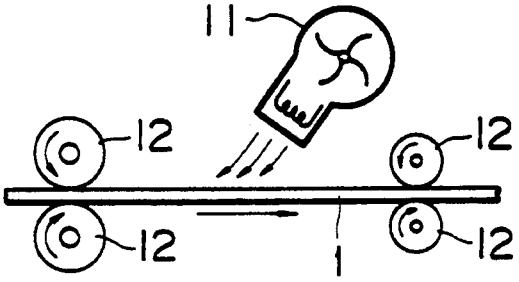
Figure 4D:
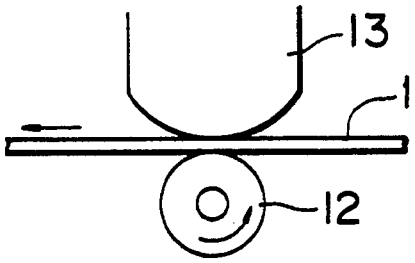

In FIG. 3, it is supposed that the reversible thermosensitive recording medium comprising a matrix resin and a low-molecular-weight material dispersed in the matrix resin is initially in a milky white opaque state at room temperature $T_0$ or below. When the recording medium is heated to temperature $T_2$, the recording medium becomes transparent. Thus, the recording medium reaches a maximum transparent state at temperature $T_2$. Even if the recording medium which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording medium in the maximum transparent state is further heated to temperature $T_3$ or more, it assumes a medium state which is between the maximum transparent state and the maximum milky white opaque state. When the recording medium in the medium state at temperature $T_3$ or more is cooled to room temperature $T_0$ or below, the recording medium returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording medium in the milky white opaque state is heated to any temperature between temperature $T_1$ and temperature $T_2$, and then cooled to the room temperature $T_0$ or below, the recording medium assumes an intermediate state between the transparent state and the milky white opaque state.

When the recording medium in the transparent state at room temperature $T_0$ is again heated to temperature $T_3$ or above, and then cooled to room temperature $T_0$, the recording medium returns to the milky white opaque state. Thus, the reversible thermosensitive recording medium according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording medium. Further, such image formation and erasure can be repeated many times.

When a colored sheet is placed behind the recording layer of the recording medium, the colored image can be obtained on the white opaque background or the white opaque image can be obtained on the colored background.

In the case where the reversible thermosensitive recording medium is projected using an OHP (Over Head Projector), a milky white opaque portion in the recording medium appears dark and a transparent portion in the recording medium through which the light passes becomes a bright portion on the screen.

The reversible thermosensitive recording medium of the type (A) for use in the present invention can be prepared, for example, by providing a recording layer in the form of a film or in the form of a sheet on a substrate as follows:

(1) A matrix resin and an organic low-molecular-weight material are dissolved in a solvent to prepare a recording layer coating liquid. The recording layer coating liquid is then coated on a substrate and the coated layer is dried to form a recording layer in the form of a film or a sheet on the substrate.

(2) A matrix resin is dissolved in a solvent which can dissolve only the matrix resin to prepare a matrix resin solution. An organic low-molecular-weight material is pulverized and the pulverized organic low-molecular-weight material is dispersed in the matrix resin resin solution to prepare a recording layer coating liquid. The recording layer coating liquid is then coated on a substrate and the coated layer is dried to form a recording layer in the form of a film or a sheet on the substrate.

(3) A matrix resin and an organic low-molecular-weight material are fused and mixed without using any solvent. The thus prepared fused mixture is coated in the form of a film or a sheet on a substrate and cooled to provide a recording layer on the substrate.

The solvent used for the formation of the recording layer can be selected depending on the kind of the matrix resin and the type of the organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. Not only when a matrix resin dispersion is used, but also when a matrix resin solution is used, the organic low-molecular-weight material is separated in the form of finely-divided particles in the matrix resin of the recording layer.

It is preferable that resins used as the matrix resin for the reversible thermosensitive recording medium for use in the present invention have excellent film-forming properties for the formation of the recording layer in the form of a film or a sheet, high transparency and high mechanical stability. Examples of such resins include polyvinyl chloride resin; vinyl chloride copolymers such as vlnyl chloride - vinyl acetate copolymer, vinyl chloride - vinyl acetate - vinyl alcohol copolymer, vinyl chloride - vinyl acetate - maleic acid copolymer, and vinyl chloride - vinyl acrylate copolymer; vinylidene chloride copolymers such as polyvinylidene chloride, vinylidene chloride - vinyl chloride copolymer, vinylidene chloride - acrylonitrile copolymer; polyester; polyamide; polyacrylate, polymethacrylate or acrylate - methacrylate copolymer; and silicone resin. These resins can be used alone or in combination.

The organic low-molecular-weight material for use in the recording layer may be appropriately selected from the materials which are changeable from the polycrystalline state to the single crystalline state in accordance with each of the desired temperatures ranging from $T_0$ to $T_3$ as shown in FIG. 3. It is preferable that the organic low-molecular-weight material have a melting point in the range of 30° to 200° C., more preferably in the range of about 50° to 150° C.

Examples of the organic low-molecular-weight material are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid, henelcosanoic acid, tricosanoic acid, lignoceric acid, pentacosanoic acid, cerotic acid, heptacosanoic acid, montanic acid, melissic acid, oleic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$,

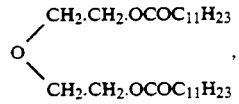

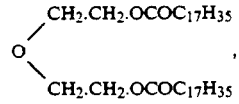

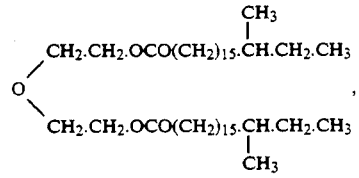

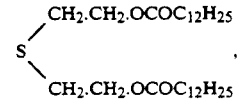

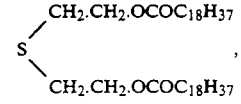

-continued

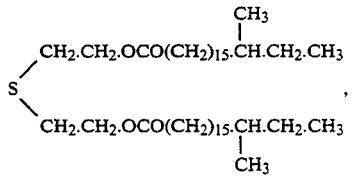

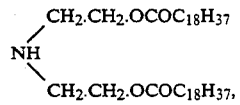

and

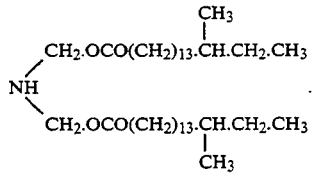

Of these, higher fatty acids having 16 or more carbon atoms, more preferably having 16 to 24 carbon atoms, such as palmitic acid, pentadecanoic acid, nonadecanoic acid, arachic acid, heneicosanoic acid, tricosanoic acid, lignoceric acid, stearic acid and behenic acid are preferred in the present invention.

It is preferable that the ratio by weight of the organic low-molecular-weight material to the matrix resin be in the range of about (2:1) to (1:16), more preferably in the range of (1:2) to (1:8) in the recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

It is preferable that the recording layer have a thickness of 1 to 30 μm, more preferably a thickness of 2 to 20 μm, in order to make the temperature distribution of the reversible thermosensitive recording layer uniform, and to obtain a uniform transparent state and a white opaque state with high contrast. The degree of the white opaqueness can be increased by increasing the amount of the organic low-molecular-weight material in the thermosensitive recording layer.

In the recording layer, additives such as a surface-active agent and a high-boiling point solvent can be employed to facilitate the formation of a transparent image.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate - amine-containing monomer copolymer; styrene - maleic anhydride copolymer; and olefin - maleic anhydride copolymer.

In the present invention, when the image formed on the reversible thermosensitive recording medium of the type (A) is observed as a reflection type image, a light reflection layer may be formed behind the recording layer to improve the contrast of the image even if the thickness of the recording layer is made thin. Specifically, the light reflection layer can be prepared by deposition of, for example, aluminum, nickel or tin on back side of the support opposite to the recording layer as described in Japanese Laid-Open Patent Application 64-14079.

A protective layer may be formed on the recording layer. It is preferable that the protective layer have a thickness of 0.1 μm to 10 μm. As the material for the protective layer, silicone rubber, silicone resin (Japanese Laid-Open Patent Application 63-221087), polysiloxane graft polymer (Japanese Laid-Open Patent Application 62-152550), ultraviolet-curing resin and electron radiation curing resin (Japanese Laid-Open Patent Application 63-310600) can be employed. In any case, the material for the protective layer is dissolved in a solvent to prepare a coating liquid and the thus prepared coating liquid is coated on the recording layer. Therefore it is desirable that the matrix resin and the organic low-molecular-weight material for use in the recording layer be not easily dissolved in such a solvent for use in the protective layer.

Examples of the above-mentioned solvent in which the matrix resin and the organic low-molecular-weight material are not easily dissolved include n-hexane, methyl alcohol, ethyl alcohol and isopropyl alcohol. In particular, alcohol solvents are preferred from the viewpoint of the cost.

Further, an intermediate layer can be interposed between the protective layer and the recording layer to protect the recording layer from the solvent or a monomer component for the protective layer formation liquid (Japanese Laid-Open Patent Application 1-133781).

Examples of the resin for use in the formation of the intermediate layer include the resins used as the matrix resin for the recording layer, and the following thermosetting resins and thermoplastic resins: polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness of about 0.1 to 2 μm.

There are varieties of thermosensitive recording apparatus for the reversible thermosensitive recording medium of the type (A) for use in the present invention.

A representative thermosensitive recording apparatus for the reversible thermosensitive recording medium of the type (A) comprises a heating element such as a thermal head which serves image formation means as well as image erasing means by changing the amount of thermal energy applied thereto.

Another representative thermosensitive recording apparatus comprises (a) image formation means such as a thermal head and (b) image erasing means of a contact pressure and heat application type such as a thermal head, a hot stamp, a heat roller, and a heat block, which is brought into contact with the reversible thermosensitive recording medium, or image erasing means of a non-contact type which applies hot air or infrared light to the recording medium.

FIGS. 4(*a*) through 4(*d*) show various image erasing units comprising any of the above-mentioned image erasing means.

FIG. 4(*a*) is a schematic illustration of a contact pressure and heat application type image erasing unit for making a reversible thermosensitive recording medium 1 transparent by bringing a hot stamp 2 into pressure contact with the recording medium 1. In the figure, reference numeral 8 indicates a stamp base.

FIG. 4(*b*) is a schematic illustration of a contact pressure and heat application type image erasing unit for making the reversible thermosensitive recording medium 1 transparent by a heat roller 9. In the figure, reference numeral 10 indicates an idle roller. In this image erasing unit, the heat roller 9 and the idle roller 10 are rotated at the same peripheral speed, and the reversible thermosensitive recording medium 1 is transported by being held between the heat roller 9 and the idle roller 10.

FIG. 4(*c*) is a schematic illustration of a non-contact heat application type image erasing unit for making the reversible thermosensitive recording medium 1 transparent by the hot air from a dryer 11. In the figure, reference numeral 12 indicates a transportation roller.

FIG. 4(*d*) is a schematic illustration of a contact pressure and heat application type image erasing unit for making the reversible thermosensitive recording medium 1 transparent by a heat block 13. In the figure, reference numeral 12 indicates a transportation roller.

A thermal head can also be used as an image erasing unit although it is not depicted in the above figures.

A thermosensitive recording image formation apparatus for conducting a method for compensating for the distortion in a recording layer of a reversible thermosensitive recording medium according to the present invention will now be explained with reference to FIG. 5(*a*) and FIG. 5(*b*).

In the thermosensitive recording image formation apparatus, a thermal head for image formation is used as image formation means for forming images on the reversible thermosensitive recording medium, and a thermal head for image erasing is used as image erasing means for erasing images on the recording medium, which are respectively referred to an image formation thermal head and an image erasing thermal head.

Figure 5A:
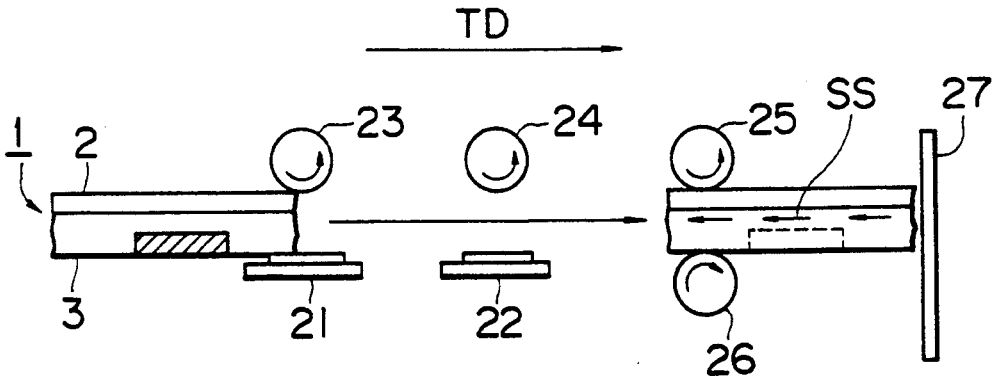
FIGS. 5(*a*) and 5(*b*) are schematic illustrations of an example of the distortion compensation method according to the present invention, in which an image formation thermal head and an image erasing thermal head are employed.
Figure 5B:
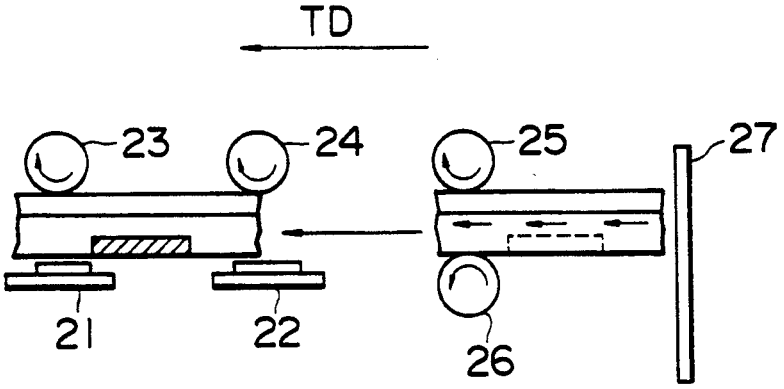

More specifically, with reference to FIG. 5(*a*), a reversible thermosensitive recording medium 1 comprising a substrate 2 and a recording layer 3 with an image formed in the recording layer 3, which is indicated by a shaded portion, is transported in the right direction in the figure by a platen roller 23. During the transportation of the recording medium 1, the image formed in the recording layer 3 is erased by the application of thermal energy from an image erasing thermal head 21. Since the image erasing thermal head 21 in operation is in slight pressure with the recording layer 3, and the recording medium 1 is moved in the right direction, a shearing stress SS is applied in the left direction to the recording layer 3, so that the recording layer 3 is distorted.

During this image erasing step, no energy is applied to an image formation thermal head 22, and only a platen roller 24 is rotated, so that the reversible thermosensitive recording medium 1 is transported up to a stopper by guide rollers 25 and 26.

The reversible thermosensitive recording medium 1 from which the image has been erased is then transported in the left direction by the guide rollers 25 and 26 as illustrated in FIG. 5(*b*). The recording medium 1 is further transported in the left direction by the platen roller 24, and a new image is then formed as indicated by a shaded portion in the recording layer 3 of the recording medium 1 by the application of thermal energy from the image formation thermal head 22.

During this image formation step, since the image formation thermal head 22 is in slight pressure contact with the recording layer 3, and the recording medium 1 is moved in the left direction, a shearing stress is also applied to the recording layer 3 in the direction opposite to the direction of the shearing stress SS applied thereto during the image erasing step (refer to FIG. 5(*a*)), so that the distortion in the recording layer 3 made during the image erasing step is compensated for. During this image formation step, no energy is applied to the image erasing thermal head 21, and only the platen roller 23 is rotated, so that the reversible thermosensitive recording medium 1 is further transported in the left direction.

In the thermosensitive recording image formation apparatus as shown in FIGS. 5(*a*) and 5(*b*), the positioning of the image erasing thermal head 21 and the image formation thermal head 21 can be reversed. Furthermore, the image erasing thermal head 21 can be replaced by an image erasing unit of a contact pressure and heat application type such as a hot stamp, a heat roller, or a heat block, which is brought into slight pressure contact with the recording layer 3 of the recording medium 1, or an image erasing unit of a non-contact type which applies hot air or infrared light to the recording layer 3 of the recording medium 1.

In the thermosensitive recording image formation apparatus as shown in FIGS. 5(*a*) and 5(*b*), even when the image erasing thermal head 21 and the image formation thermal head 22 can be replaced by a single thermal head which can perform image formation and image erasing by changing thermal energy to be applied to the reversible thermosensitive recording medium 1, the distortion in the recording layer 3 during the image erasing step can be compensated for during the image formation step in the same manner as described above with reference to FIGS. 5(*a*) and 5(*b*).

More specifically, the reversible thermosensitive recording medium 1 comprising the substrate 2 and the recording layer 3 with an image formed in the recording layer 3 is transported in the right direction. During the transportation of the recording medium 1, the image formed in the recording layer 3 is erased by the application of thermal energy from the single thermal head. Since the single thermal head in operation also applies pressure to the recording layer 3, the recording layer 3 is distorted by the shearing stress SS in the left direction which works in the recording layer 3 with the single thermal head.

The reversible thermosensitive recording medium 1 is then transported up to the stopper by guide rollers 25 and 26.

The reversible thermosensitive recording medium 1 from which the image has been erased is then transported in the left direction, and a new image is then formed in the recording layer 3 of the recording medium 1 by the application of thermal energy from the same single thermal head.

During this image formation step, the single thermal head also applies pressure to the recording layer 3 in the direction of the depth thereof, and a shearing stress is also applied to the recording layer 3 in the direction opposite to the direction of the shearing stress SS applied thereto during the image erasing step, so that the distortion in the recording layer 3 made during the image erasing step is compensated for.

Thus the distortion in the recording layer 3 of the reversible thermosensitive recording medium 1 can be compensated for by the single thermal head in the same manner as in the case where both the image erasing thermal head 21 and the image formation thermal head 22 are employed.

Figure 6:
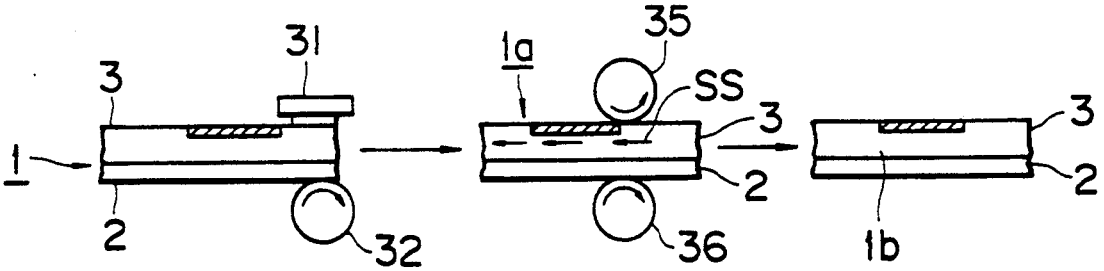
FIG. 6 is a schematic illustration of another example of the distortion compensation method according to the present invention, in which an image formation thermal head and guide rollers positioned behind the the thermal head, which serve as pressure application means are employed.
Figure 7A:
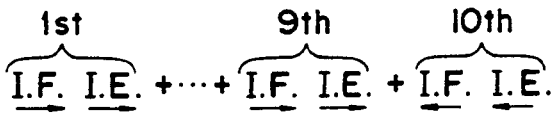
FIGS. 7(*a*) to 7(*q*) are diagrams showing varieties of energy application modes for compensating for the distortion in the recording layer of the reversible thermosensitive recording medium.
Figure 7B:
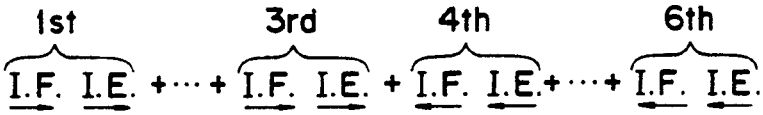
Figure 7C:
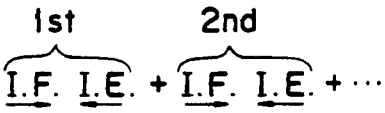
Figure 7D:
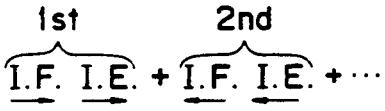
Figure 7E:
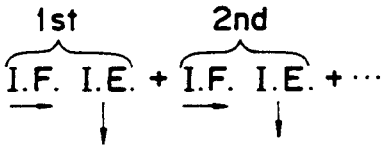
Figure 7F:
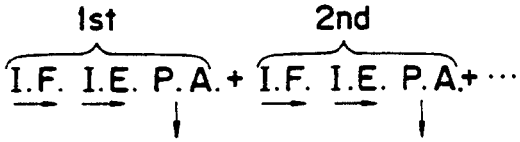
Figure 7G:
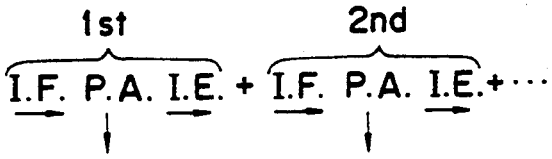
Figure 7H:
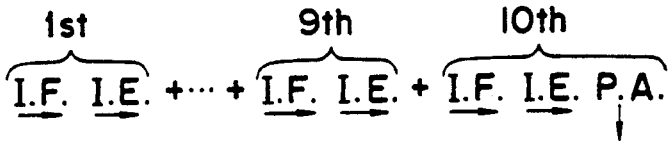
Figure 7I:
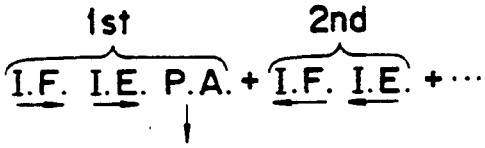
Figure 7J:
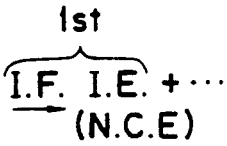
Figure 7K:
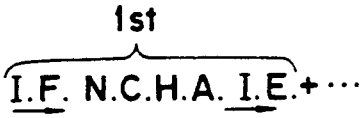
Figure 7L:
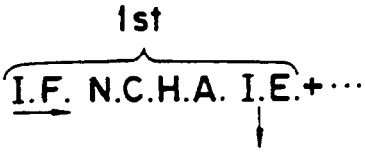

FIG. 6 shows another thermosensitive recording image formation apparatus which comprises a thermal head serving as image formation means for forming images on the reversible thermosensitive recording medium 1 and image erasing means for erasing images formed on the recording medium 1, and guide rollers which serve as pressure application means for compensating for the distortion in the recording layer 3 of the reversible thermosensitive recording medium 3 and are located behind the thermal head.

In FIG. 6, a reversible thermosensitive recording medium 1 comprising a substrate 2 and a recording layer 3 with an image formed in the recording layer 3 is transported in the right direction by a platen roller 32. During the transportation of the recording medium 1, the image formed in the recording layer 3 is erased by the application of thermal energy from a thermal head 31 for image erasing and image formation and a new image is formed by the thermal head 31 so that a reversible thermosensitive recording medium 1*a* with the new image is formed. Since the thermal head 31 in operation is in slight pressure contact with the recording layer 3, the recording layer 3 is distorted by the shearing stress SS indicated by the arrows in the left direction.

The reversible thermosensitive recording medium 1*a* with the new image is further transported in the right direction by the platen roller 32, and is further transported in the right direction by being held between a pair of guide rollers 35 and 36. During the transportation of the recording medium 1*a* by the guide rollers 35 and 36, the distortion in the recording layer 3 is compensated for by a shearing stress which is applied to the recording layer 3 in a direction opposite to the above-mentioned shearing stress SS, so that a reversible thermosensitive recording medium 1*b* free from the distortion in the recording layer 3 thereof is formed as shown in FIG. 6.

In the thermosensitive recording image formation apparatus as shown in FIGS. 5(*a*) and 5(*b*), and FIG. 6, the effective frequency of the application of the stress and/or heat to the recording layer 3 of the reversible thermosensitive recording medium 1 in a direction different from that of the preceding application of the shearing stress in order to compensate for the distortion in the recording layer 3 may be one time per one to several ten times of the preceding application.

FIGS. 7(*a*) to 7(*q*) show varieties of energy application modes for compensating for the distortion in the recording layer 3. In these figures, I.F. denotes image formation; I.E. denotes image erasing; the arrows indicate the direction of the application of stress to the recording 3 of the reversible thermosensitive recording medium 1; P.A. denotes pressure application; N.C.E denotes non-contact erasing; N.C.H.A. denotes non-contact heat application; and C.H.A. denotes contact heat application.

In the energy application mode shown in FIG. 7(*a*), stress is applied to the recording layer 3 in the same direction as indicated by the arrows in both an image formation unit and an image erasing unit. This cycle of stress application is repeated 9 times, and at the 10th cycle, the direction of stress application is reversed in both the image formation unit and the image erasing unit. These 10 cycles are repeated.

In the energy application mode shown in FIG. 7(*b*), stress is applied to the recording layer 3 in the same direction as indicated by the arrows in both the image formation unit and the image erasing unit. This cycle of the stress application is repeated 3 times, and at the 4th cycle through the 6th cycle, the direction of stress application is reversed in both the image formation unit and the image erasing unit. These 6 cycles are repeated.

In the energy application mode shown in FIG. 7(*c*), stress is applied to the recording layer 3 in the opposite direction as indicated by the arrows in the image formation unit and in the image erasing unit. This cycle of the stress application is repeated.

In the energy application mode shown in FIG. 7(*d*), stress is applied to the recording layer 3 in the same direction as indicated by the arrows in both the image formation unit and the image erasing unit at the 1st cycle. At the 2nd cycle, the stress application direction is reversed in both the image formation unit and the image erasing unit. These 2 cycles are repeated.

In the energy application mode shown in FIG. 7(*e*), stress is applied to the recording layer 3 in one direction as indicated by the arrow in the image formation unit, and stress in a direction substantially perpendicular to the direction of the stress application in the image formation unit is applied to the recording layer 3 in the image erasing unit. This cycle of the stress application is repeated.

In the energy application mode shown in FIG. 7(*f*), stress is applied to the recording layer 3 in the same direction as indicated by the arrows in both the image formation unit and the image erasing unit, and pressure is then applied to the recording layer 3 in a direction different from the stress application direction in the above-mentioned image formation unit and the image erasing unit at the 1st cycle. The pressure application direction includes, for instance, a direction substantially perpendicular to the the stress application direction in the image formation unit and the image erasing unit. This cycle is repeated.

In the energy application mode shown in FIG. 7(*g*), stress is applied to the recording layer 3 in one direction as indicated by the arrow in the image formation unit, pressure is then applied to the recording layer 3 in a direction different from the stress application direction in the above-mentioned image formation unit, and stress in the same direction as in the image formation unit is applied to the recording layer 3 in the image erasing unit at the 1st cycle. The pressure application direction includes, for instance, a direction substantially perpendicular to the the stress application direction in the image formation unit and the image erasing unit. This cycle is repeated.

In the energy application mode shown in FIG. 7(*h*), stress is applied to the recording layer 3 in the same direction as indicated by the arrows in both the image formation unit and the image erasing unit. This cycle of the stress application is repeated 9 times, and at the 10th cycle, stress is applied to the recording layer 3 in the same direction as indicated by the arrows in both the image formation unit and the image erasing unit, and pressure is then applied to the recording layer 3 in a direction different from that in the above-mentioned image formation unit and image erasing unit. The pressure application direction includes, for instance, a direction substantially perpendicular to the the stress application direction in the image formation unit and the image erasing unit. These 10 cycles are repeated.

In the energy application mode shown in FIG. 7(*i*), stress is applied to the recording layer 3 in the same direction as indicated by the arrows in both the image formation unit and the image erasing unit, and pressure is then applied to the recording layer 3 in a direction different from that in the above-mentioned image formation unit and image erasing unit at the 1st cycle. The pressure application direction includes, for instance, a direction substantially perpendicular to the the stress application direction in the image formation unit and the image erasing unit. At the 2nd cycle, the direction of the stress applied to the recording layer 3 in the image formation unit and the image erasing unit is reversed. These two cycles of the stress application is repeated The energy application mode shown in FIG. 7(*i*) is significantly effective for compensating for the distortion in the recording layer 3.

In the energy application mode shown in FIG. 7(*j*), stress is applied to the recording layer 3 in one direction as indicated by the arrow in the image formation unit, and image erasing is conducted by non-contact erasing, for instance, non-contact heat application, in the image erasing unit. This cycle is repeated.

In the energy application mode shown in FIG. 7(*k*), stress is applied to the recording layer 3 in one direction as indicated by the arrow in the image formation unit, non-contact heat application is conducted to the recording layer 3 to a temperature above the image formation temperature for the recording layer 3, and stress in the same direction as that applied to the recording layer 3 in the image formation unit is applied to the recording layer 3 in the image erasing unit. This cycle is repeated.

In the energy application mode shown in FIG. 7(*l*), stress is applied to the recording layer 3 in one direction as indicated by the arrow in the image formation unit, non-contact heat application is conducted to the recording layer to a temperature above the image formation temperature for the recording layer 3, and stress in a direction substantially perpendicular to the direction of the stress applied to the recording layer 3 in the image formation unit is applied to the recording layer 3 in the image erasing unit. This cycle is repeated.

In the energy application mode shown in FIG. 7(*m*), stress is applied to the recording layer 3 in one direction as indicated by the arrow in the image formation unit, non-contact heat application is conducted to the recording layer to a temperature above image formation temperature, and stress in a direction opposite to that of the stress applied to the recording layer 3 in the image formation unit is applied to the recording layer 3 in the image erasing unit. This cycle is repeated.

In the energy application mode shown in FIG. 7(*n*), stress is applied to the recording layer 3 in one direction as indicated by the arrow in the image formation unit, contact heat application is conducted to the recording layer to a temperature above image formation temperature, and stress in the same direction as that applied to the recording layer 3 in the image formation unit is applied to the recording layer 3 in the image erasing unit. This cycle is repeated.

In the energy application mode shown in FIG. 7(*o*), stress is applied to the recording layer 3 in one direction as indicated by the arrow in the image formation unit, contact heat application is conducted to the recording layer 3 to a temperature above the image formation temperature for the recording layer 3, and stress in a direction perpendicular to that of the stress applied to the recording layer 3 in the image formation unit is applied to the recording layer 3 in the image erasing unit. This cycle is repeated.

In the energy application mode shown in FIG. 7(*p*), stress is applied to the recording layer 3 in one direction as indicated by the arrow in the image formation unit, contact heat application is conducted to the recording layer 3 to a temperature above the image formation temperature for the recording layer 3, and stress in a direction opposite to that of the stress applied to the recording layer 3 in the image formation unit is applied to the recording layer 3 in the image erasing unit. This cycle is repeated.

In the energy application mode shown in FIG. 7(*q*), stress is applied to the recording layer 3 in one direction as indicated by the arrow in the image formation unit, non-contact heat application is conducted to the recording layer 3 to a temperature above the image formation temperature for the recording layer 3, and image erasing is conducted by non-contact erasing, for instance, non-contact heat application, in the image erasing unit. This cycle is repeated.

Figure 8:
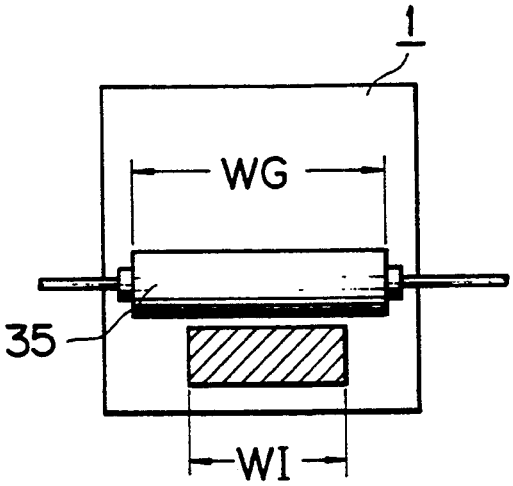
FIG. 8 is a schematic illustration of an example of a guide roller which serves as pressure application means in a thermosensitive recording image formation apparatus.
Figure 9:
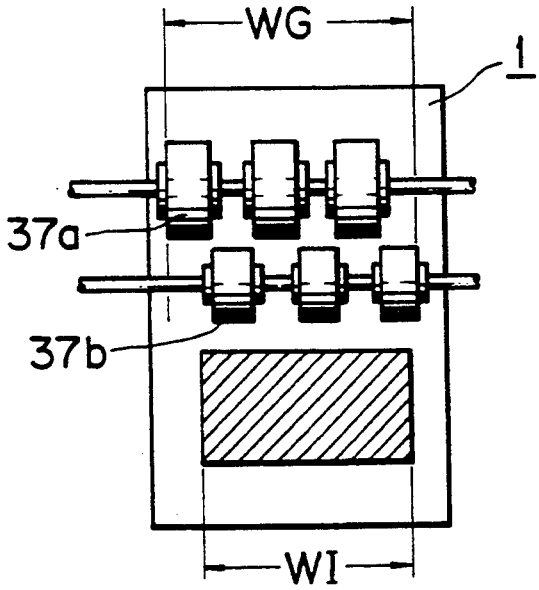
FIG. 9 is a schematic illustration of an example of a plurality of guide rollers which serves as pressure application means in a thermosensitive recording image formation apparatus.
Figure 10:
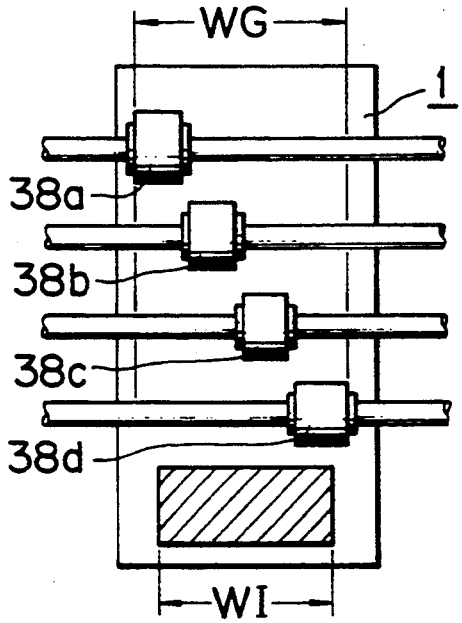
FIG. 10 is a schematic illustration of another example of a plurality of guide rollers which serves as pressure application means in a thermosensitive recording image formation apparatus.

In the thermosensitive recording image formation apparatus shown in FIG. 6, the durability of the image formation and image erasing area of the reversible thermosensitive recording medium 1 can be improved by designing the width WG of each of the guide rollers 35 and 36 (which serve as pressure application means) larger than the width W1 of the image formation and image erasing area as illustrated in FIG. 8. In FIG. 8, only the guide roller 35 is shown.

The durability of the reversible thermosensitive recording medium 1 can be further improved by increasing the pressure that can be applied by such a guide roller as the guide roller 35, by increasing the number of the guide rollers, and by setting such a guide roller before and after the image formation and image erasing area because these measures can increase the stress that can used to compensate for the distortion in the recording layer 3.

Alternatively, the durability of the image formation and image erasing area of the reversible thermosensitive recording medium 1 can be improved by providing a plurality of such guide rollers as indicated by 37*a* and 37*b*. This is because each of these guide rollers is narrower than the guide roller 35, so that the pressure per unit applied by each of the rollers 37*a* and 37*b* is larger than that applied by the roller 35, but the total energy application width of the guide rollers 37*a* and 37*b* is larger than that of the guide roller 35, whereby the stress for compensating for the distortion in the recording layer 3 can be increased.

It is preferable that the number of the above-mentioned pressure application means be increased for the improvement of the durability of the image formation and image erasing area of the reversible thermosensitive recording medium 1, with the shape and rigidity of the pressure application means.

It is preferable that the pressure applied by the pressure application means be at least 0.1 kg/cm$^2$, more preferably 0.5 kg/cm$^2$ or more, and most preferably 1.0 kg/cm$^2$.

It is preferable that the pressure application means be positioned before and after a heating element which performs image formation and/or image erasing, within a 100 cm straight-line distance therefrom, more preferably with a 30 cm straight-line distance therefrom. By minimizing the distance between the pressure application means and the heating element, the distortion in the recording layer 3, which is formed by the application of thermal energy and/or pressure by the heating element, can be compensated for before the distortion is fixed, so that the durability of the image formation and image erasing area of the reversible thermosensitive recording medium 1 can be further improved.

Furthermore, when a thermostating heating element is built in the above-mentioned pressure application means, heat application and pressure application be conducted simultaneously, so that the distortion in the recording layer 3 can be effectively compensated for by the softening of the matrix resin in the recording layer 3 by the heat applied by the heating element, and by the pressure applied by the pressure application means.

When the above-mentioned pressure application means is heated by the built-in heating element, it is preferable that the temperature of the pressure application means be set above the image formation temperature for the reversible thermosensitive recording medium.

When the reversible thermosensitive recording medium is heated by the pressure application means with the above-mentioned temperature setting, the organic low-molecular-weight material dispersed in the matrix resin in the reversible thermosensitive recording medium is fused, and the matrix resin itself becomes soft because the matrix resin is heated to a temperature above the softening point thereof. As a result, the shape of the deformed particles of the organic low-molecular-weight material is caused to return to their original spherical by the interfacial tension between the organic low-molecular-weight material and the matrix resin under the above-mentioned conditions, so that the distortion in the recording layer 3 is compensated for and the shearing stress worked within the recording layer 3 is removed by the pressure applied by the above-mentioned pressure application means.

Furthermore, in the present invention, the distortion in the recording layer 3 can be compensated for by changing the transporting direction during the image formation and image erasing steps.

In the case where image recording and image erasing are repeatedly carried out by use of a thermal head in the recording layer 3 of the reversible thermosensitive recording medium 1 in the present invention, the shearing stress can be removed from the recording layer 3 by moving intermittently the thermal head relative to the reversible thermosensitive recording medium 1 and applying printing energy pulses to the recording medium 1 during the intermittent movement of the recording medium 1 relative to the thermal head.

The same effect as mentioned above can also be obtained by minutely changing the moving directions of the recording medium 1 during the formation of picture elements on the recording medium by the thermal head.

When the recording medium 1 is heated by a thermal head for image formation, the recording medium 1 is intermittently moved by a pulse motor.

Figure 11:
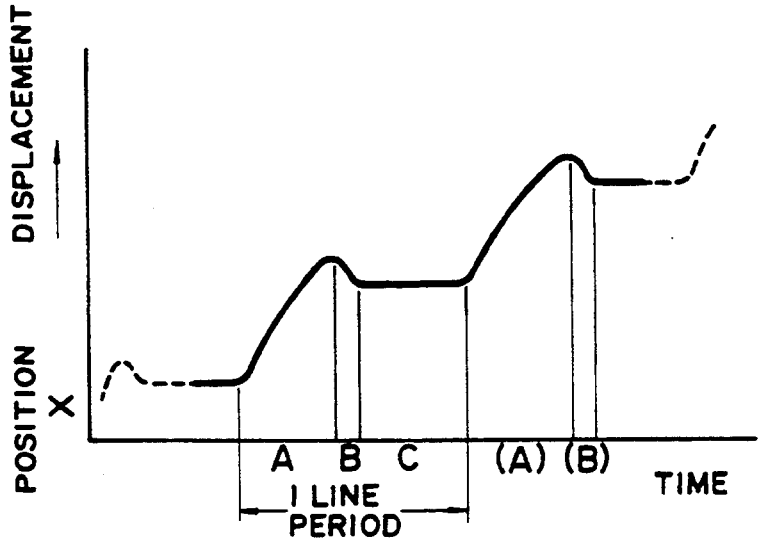
FIG. 11 is a diagram showing the intermittent movement of a thermal head relative to a reversible thermosensitive recording medium.
Figure 12A:
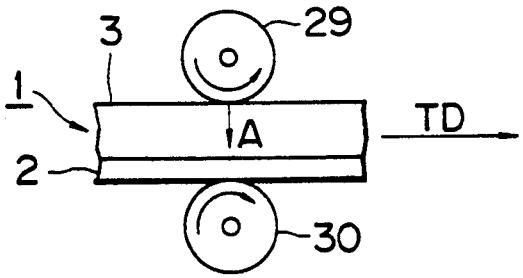
FIGS. 12(*a*) to 12(*e*) are schematic illustrations of a variety of pressure and/or heat application unit for use in a thermosensitive recording image formation apparatus.
Figure 12B:
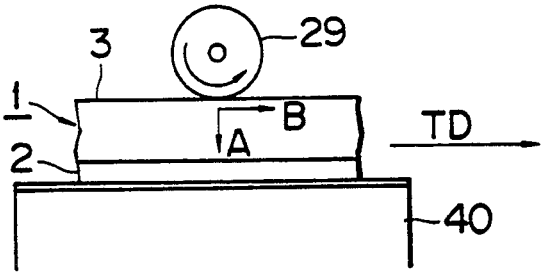
Figure 12C:
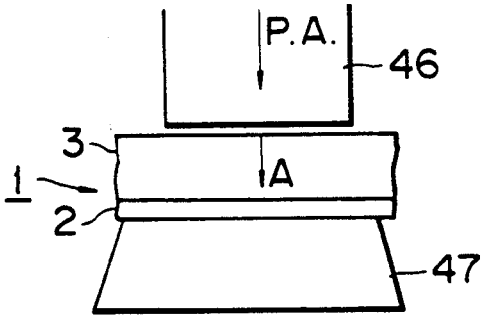
Figure 12D:
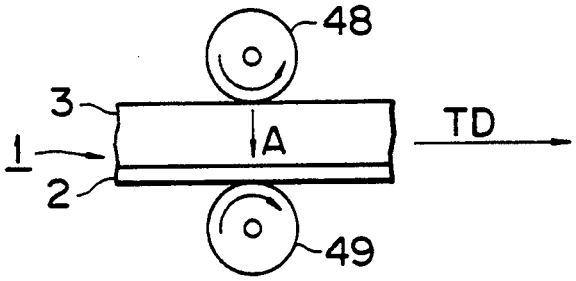
Figure 12E:
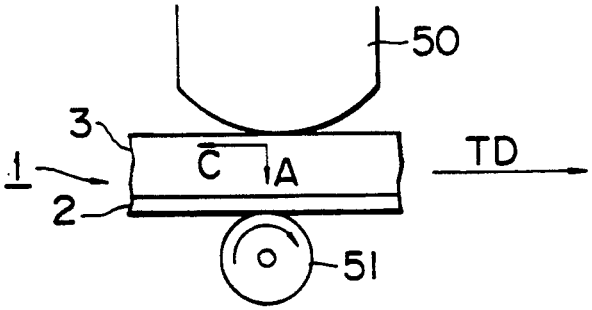

The intermittent movement of the thermal head relative to the recording medium 1 is carried out, for instance, as shown in FIG. 11. In the figure, reference symbol A denotes forward moving period, reference symbol B denotes backward moving period, and reference symbol C denotes stationary period. Generally the width of each printing pulse is set at a half or less of the line period.

In the printing method shown in FIG. 11, it is preferable to perform the application of a printing pulse at a position with the interval corresponding to the periods A to B. In the backward moving period B, the moving direction of the thermal head is reversed, so that the shearing stress is also reversed. Therefore, even when some distortion is formed in the recording layer 3 during the forward moving period A, the distortion can be compensated for during the backward moving period B.

The above-mentioned printing method is very effective for preventing the distortion in the recording layer 3 caused by the shearing stress which works within the recording 3 even when the reversible thermosensitive recording medium 1 has not been cooled at the initiation of the movement of the recording medium 1. In order to utilize the above-mentioned effect most effectively, it is preferable to apply printing pulses at such a timing that includes the forward moving period A or both the forward moving period A and the backward moving period B.

The shearing stress between the thermal head and the recording layer 3 of the recording medium 1 is cancelled by the backward stress during the backward moving period B, so that the accumulation of the shearing stress can be prevented, and accordingly, the decrease in image density during repeated image formation can be prevented. Thus, the deterioration of the recording medium can be prevented.

In FIG. 6 and FIGS. 8–10, various guide rollers are shown as examples of the pressure application means. As such pressure application means, a hot stamp, a heat roller, and a heat block can also be employed, which are previously given as examples of the image erasing means. These can be used as either means which can perform the application of both thermal energy and pressure, or means which can perform the application of pressure only, without the application of thermal energy.

The directions of the stress applied to the reversible thermosensitive recording recording medium 1 by the above-mentioned various pressure and/or heat application means are considered as follows with reference to FIG. 12(*a*) through FIG. 12(*e*):

FIG. 12(*a*) shows a schematic illustration of a pressure application unit comprising an upper guide roller 29 and a lower guide roller 30. The reversible thermosensitive recording medium 1 comprising a substrate 2 made of a PET film and a recording layer 3 is transported between the guide rollers 29 and 30 in a direction TD. In this pressure application unit, since the peripheral speed of the upper guide roller 29 is the same as that of the lower guide roller 30, it is considered that substantially no stress is generated in the direction parallel to the transporting direction TD within the recording layer 3, but only stress A in a direction perpendicular to the transporting direction TD of the reversible thermosensitive recording medium 1 is applied to the recording layer 3.

FIG. 12(*b*) shows a schematic illustration of another pressure application unit comprising a guide roller 29 and a support 40. Since the reversible thermosensitive recording medium 1 is transported between the support 40 and the guide roller 29, and the support 40 is fixed and only the guide roller 29 is rotated in contact with the recording layer 3, it is considered that not only stress A in the direction perpendicular to the transporting direction TD of the recording medium 1, but also stress in a direction parallel to the transporting direction TD of the recording medium 1 is applied to the recording layer 3.

FIG. 12(*c*) shows a schematic illustration of a pressure and heat application unit comprising a hot stamp 46 and a stamp base 47. In this pressure and heat application unit, since the reversible thermosensitive recording medium 1 is not moved between the hot stamp 46 and the stamp base 47, and only the hot stamp 46 is brought into pressure contact with the recording medium 1 in a direction perpendicular to the recording medium 1 as indicated by the arrow P.A., it is considered that only stress A in the direction perpendicular to the recording medium 1 is applied thereto.

FIG. 12(*d*) shows a schematic illustration of a pressure application and heat application unit comprising a heat roller 48 and an idle roller 49. The reversible thermosensitive recording medium 1 is transported between the heat roller 48 and the idle roller 49 in a direction TD. In this pressure and heat application unit, since the peripheral speed of the heat roller 48 is the same as that of the idle roller 49, it is considered that substantially no stress is generated in a direction parallel to the transporting direction TD within the recording layer 3, but only stress A in a direction perpendicular to the transporting direction TD of the reversible thermosensitive recording medium 1 is applied to the recording layer 3.

FIG. 12(*e*) shows a schematic illustration of a pressure and heat application unit comprising a heat block 50 and a transportation roller 51. In this pressure and heat application unit, the heat block 50 is stationary, the transportation roller 51 is rotated in the direction of the arrow, and the reversible thermosensitive recording medium 1 is transported between the heat block 50 and the transportation roller 51 in a direction TD. In this pressure and heat application unit, it is considered that stress in a range between stress A in a direction perpendicular to the transporting direction TD, and stress C in a direction parallel to the transporting direction TD is applied to the recording layer 3 of the recording medium 1.

In the pressure and heat application unit as shown in FIG. 12(*e*), since the direction of stress C is opposite to that of stress B generated in the recording medium 1 shown in FIG. 2(*b*), stress in the same direction as that of stress B in the recording medium 1 shown in FIG. 2(*b*) can be generated by reversing the transporting direction TD of the recording medium 1 in FIG. 12(*e*).

The pressure application means for the above-mentioned recording image formation apparatus for use in the present invention can be made of an organic polymer, a metallic material or an inorganic material other than metallic materials.

Examples of the organic polymer include rubber materials such as natural rubber, SBR (styrene - butadiene rubber), IR (isoprene rubber), BR (butadiene rubber), EPR (ethylene - propylene rubber), butyl rubber, neoprene, NBR (nitrile rubber), polysulfide rubber, silicone rubber, fluororubber (Kel-F), viton A, chloroprene rubber, and acrylic rubber; polystyrene, and high-impact polystyrene; ABS resin; low-density polyethylene; high-density polyethylene; polypropylene; non-rigid polyvinyl chloride; rigid polyvinyl chloride; polymethyl methacrylate; high-impact polymethyl methacrylate; polycarbonate; polyacetal (Trademark "Derlin", made by E.I. du Pont de Nemours & Co.); poly-3,3-bis (chloromethyl) oxetane (Trademark "Penton", made by Hercules Power Co. Inc.); polyamide; nylon-6, nylon-66, polytetrafluoroethylene (Trademark "Teflon", made by E.I. du Pont de Nemours & Co.); polychlorotrifluoroethylene (Kel-F); acetylcellulose; ethyl cellulose; phenolic resin; urea resin; melamine resin; unsaturated polyester resin; epoxy resin; and silicone resin.

Examples of the metallic material are carbon steel (C 0.20%, C=0.15–0.25%, C=0.25–0.45%, C=0.45–0.60%, C>0.60%), electrolytic iron, tinplate, case hardening chromium steel, high tensile structural chromium steel, case hardening nickel-chrome steel, high tensile structural nickel-chromium steel, ultrahigh strength steel SAE4340, cast iron, brass (65/35), phosphor bronze 5%, nickel-copper alloy, aluminum, high-strength aluminum alloy, casting of magnesium alloy, extruded form of magnesium, titanium, zinc alloy, casting lead, uranium (rolled at 300° C.), zirconium, tantalum, berylium, tungsten, molybdenum, silver, gold, palladium, iridium, pure iron, mild steel, stainless steel, pure aluminum, duralumin, nickel, Monel metal, lead, tin, and materials obtained by coating these materials with organic polymers.

Examples of the inorganic material are silica glass, flat glass, reinforced glass, concrete, chamotte brick, graphite, carbon, stoneware, porcelain, and materials obtained by coating these inorganic materials with organic polymers.

The reversible thermosensitive recording medium can be recovered from a deteriorated state, which is caused by the repeated image formation and image erasing, by applying thermal energy thereto, using non-contact type heat application means. The recovery of the recording medium is considered to be carried out by the following mechanism:

It is considered that in an initial state of the recording medium, the organic low-molecular-weight material is dispersed in the form of substantially spherical particles in the matrix resin. When the recording medium is deformed in the course of image formation, for instance, by a thermal head, the spherical particles of the organic low-molecular-weight material are also deformed. When the recording medium is heated, the organic low-molecular-weight material dispersed in the matrix resin is fused, and the the temperature of the matrix resin which is present around the particles of the organic low-molecular-weight material is raised to a temperature above the softening point thereof, so that the matrix resin become very soft. As a result, the shape of the deformed particles of the organic low-molecular-weight material is caused to return to their original spherical by the interfacial tension between the organic low-molecular-weight material and the matrix resin under the above-mentioned conditions.

Other features of this invention will become apparent in the course of the following description of exemplary embodiments which are given for illustration of the invention and are not intended to be limiting thereof.

EXAMPLE 1

Preparation of Reversible Thermosensitive Recording Medium Formation of Light Reflection Layer Aluminum was vacuum-deposited on a polyester film with a thickness of about 188 μm, serving as a support, so that a light reflection layer with a thickness of about 400 Å was formed on the polyester film.

Formation of Recording Layer

The following components were mixed to prepare a recording layer coating liquid:

| | Parts by Weight |
|---|---|
| Stearic acid | 5 |
| Eicosanedioic acid | 5 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 25 |
| Tetrahydrofuran | 150 |
| Toluene | 15 |

The above prepared recording layer coating liquid was coated on the above-prepared light reflection layer and dried under application of heat thereto, so that a recording layer (i.e., reversible thermosensitive recording layer) with a thickness of about 5 μm was formed on the light reflection layer.

Formation of Intermediate Layer

The following components were mixed to prepare an intermediate layer coating liquid:

| | Parts by Weight |
|---|---|
| Polyamide resin (Trademark "CM8000", made by Toray Industries Inc.) | 10 |
| Methyl alcohol | 90 |

The above prepared intermediate layer coating liquid was coated on the above-prepared recording layer and dried under application of heat thereto, so that an intermediate layer with a thickness of about 1 μm was formed on the recording layer.

Formation of Protective Layer

The following components were mixed to prepare a protective layer coating liquid:

| | Parts by Weight |
|---|---|
| 75% butyl acetate solution of urethane-acrylate-based ultraviolet curing resin (Trademark "Unidic C7-157" made by Dainippon Ink & Chemicals, Incorporated) | 10 |

-continued

| | Parts by Weight |
|---|---|
| Toluene | 10 |

The above prepared protective layer coating liquid was coated on the above formed recording layer, dried, and cured using of an ultraviolet lamp of 80 W/cm, so that a protective layer with a thickness of about 2 μm was formed on the intermediate layer, whereby a reversible thermosensitive recording medium No. 1 for use in the present invention was prepared.

The above obtained reversible thermosensitive recording medium No. 1 was subjected to a durability test by repeating image formation and erasure thereon under the following conditions, so that the durability of the reversible thermosensitive recording medium No. 1 was tested:

| | |
|---|---|
| Thermosensitive recording printing apparatus: | Thermal head printing test apparatus (commercially available from Yashiro Denki Co., Ltd.) |
| Thermal head: | 8 dots/mm thermal head (commercially available from Ricoh Co., Ltd.) |
| Pulse width: | 1 msec |
| Applied voltages: | 29 V for white opque image formation; and 25 V for image erasing |

The application of energy to the recording medium for the formation of white opaque images and the erasure thereof was regarded as one cycle of the energy application. 5 cycles of the energy application were conducted to the reveresible thermo-sensitive recording medium No. 1 in one direction, and then 5 cycles of the energy application were conducted to the recording medium in a reverse direction, which was opposite to the first mentioned direction for the energy application. 100 cycles of the above energy application in total were conducted under the same conditions.

The density of the white opaque images at the first cycle and that at the 100th cycle were measured by Macbeth reflection-type densitometor RD-914. The results are shown in Table 1.

EXAMPLE 2

The reversible thermosensitive recording medium prepared in Example 1 was subjected to the following durability test:

The application of energy to the recording medium for the formation of white opaque images in one direction, and for the erasure thereof in a direction opposite to the energy application direction in the formation of white opaque images was regarded as one cycle of the energy application, and 100 cycles of this energy application were repeated. The results of this durability test are shown in Table 1.

EXAMPLE 3

The reversible thermosensitive recording medium prepared in Example 1 was subjected to the following durability test:

The application of energy to the recording medium for the formation of white opaque images and the erasure thereof in one direction was regarded as one cycle of the energy application, and in the next cycle, the energy application direction was reversed. Thus 100 cycles of the energy application were repeated. The results of this durability test are shown in Table 1.

EXAMPLE 4

The reversible thermosensitive recording medium prepared in Example 1 was subjected to the following durability test:

The application of energy to the recording medium for the formation of white opaque images and the erasure thereof in one direction was regarded as one cycle of the energy application, and 100 cycles of this energy application were repeated, provided that the recording medium was caused to pass between a pair of guide rollers made of chloroprene which was adjusted to apply a pressure of 1 kg/cm$^2$ to the recording medium after each cycle of the energy application. The results of this durability test are shown in Table 1.

EXAMPLE 5

The durability test conducted in Example 4 was repeated except that the pressure of the guide rollers was changed from 1 kg/cm$^2$ to 2 kg/cm$^2$. The results of this durability test are shown in Table 1.

EXAMPLE 6

The durability test conducted in Example 4 was repeated except that the recording medium was caused to pass between the guide rollers three times after each cycle of the energy application. The results of this durability test are shown in Table 1.

COMPARATIVE EXAMPLE 1

The durability test conducted in Example 1 was repeated except that the cycle in Example 1 was repeated 100 times without changing the energy application direction. The results of this durability test are shown in Table 1.

EXAMPLE 7

White opaque images were formed on the same reversible thermosensitive recording medium as employed in Example 1 in the same manner as in Example 1. The thus formed white opaque images were erased by heating the recording medium to the erasing temperature thereof by a heat roller of an image fixing roller for a copying machine. This application of energy to the recording medium for the formation of the white images by the thermal head and the erasure thereof by the heat roller was regarded as one cycle of the energy application. This cycle was repeated 100 times, so that the durability of the recording medium was tested. The results of this durability test are shown in Table 1.

EXAMPLE 8

A durability test conducted to the reversible thermosensitive recording medium prepared in Example 1 as follows:

The application of energy to the recording medium for the formation of white opaque images and the erasure thereof in one direction was regarded as one cycle of the energy application, and 100 cycles of this energy application were conducted, provided that the heat roller employed in Example 7 was brought into contact with recording medium with the application of a pressure of 1 kg/cm$^2$ after each cycle of the energy application. The results of this durability test are shown in Table 1.

EXAMPLE 9

The procedure for the durability test conducted in Example 8 was repeated except that the temperature of the heat roller was set at a temperature for making the recording layer white opaque, whereby a durability test was conducted. The results of this durability test are shown in Table 1.

EXAMPLE 10

The procedure for the durability test conducted in Example 7 was repeated except that the heat roller employed in Example 7 was replaced by a hot stamp with the temperature thereof raised to an image erasing temperature, and the heat application time set for 0.5 seconds, whereby a durability test was conducted. The results of this durability test are shown in Table 1.

EXAMPLE 11

The procedure for the durability test conducted in Example 8 was repeated except that the heat roller employed in Example 8 was replaced by a hot stamp with the temperature thereof raised to an image erasing temperature, and the heat application time set for 0.5 seconds, whereby a durability test was conducted. The results of this durability test are shown in Table 1.

EXAMPLE 12

The procedure for the durability test conducted in Example 9 was repeated except that the heat roller employed in Example 9 was replaced by a hot stamp with the temperature thereof raised to an image erasing temperature, and the heat application time set for 0.5 seconds, whereby a durability test was conducted. The results of this durability test are shown in Table 1.

EXAMPLE 13

White opaque images were formed on the reversible thermosensitive recording medium prepared in Example 1 in accordance with the printing method as shown in FIG. 11 by intermittently moving the recording medium by a step motor, with a forward moving period A, and a backward moving period B. The thus formed white opaque images were erased by the same hot stamp as employed in Example 10. This image formation and image erasing cycle was repeated 500 times.

In this printing method, the forward moving period A was set at about 2 msec, the backward moving period B was set at about 1 msec, and the stationary period C was set at about 17 msec. For the image formation, a printing pulse with a duration of 2 msec was employed, and the application thereof to the recording medium was started at the initiation of the forward moving period B.

The results of this durability test are shown in Table 2.

EXAMPLE 14

The procedure for the durability test in Example 13 was repeated except that the forward moving period A was changed from about 2 msec to about 3 msec, and the backward moving period B was omitted, whereby a durability test was conducted.

The results of this durability test are shown in Table 2.

TABLE 1

| | White Opaque Density | |
|---|---|---|
| | 1st Cycle | 100th Cycle |
| Example 1 | 0.45 | 0.58 |
| Example 2 | 0.44 | 0.56 |
| Example 3 | 0.46 | 0.53 |
| Example 4 | 0.47 | 0.65 |
| Example 5 | 0.45 | 0.63 |
| Example 6 | 0.46 | 0.60 |
| Example 7 | 0.46 | 0.50 |
| Example 8 | 0.45 | 0.52 |
| Example 9 | 0.44 | 0.49 |
| Example 10 | 0.46 | 0.51 |
| Example 11 | 0.46 | 0.52 |
| Example 12 | 0.45 | 0.48 |
| Comparative Example 1 | 0.45 | 1.22 |

TABLE 2

| | White Opaque Density | | | |
|---|---|---|---|---|
| | 1st Cycle | 10th Cycle | 100th Cycle | 500th Cycle |
| Example 13 | 0.57 | 0.56 | 0.57 | 0.57 |
| Example 14 | 0.57 | 0.56 | 0.59 | 0.65 |

EXAMPLE 15

Preparation of Reversible Thermosensitive Recording Medium

Formation of Recording Layer

The following components were mixed to prepare a recording layer coating liquid:

| | Parts by Weight |
|---|---|
| Behenic acid | 7 |
| Eicosanedioic acid | 3 |
| Diisodecyl phthalate | 2 |
| Vinyl chloride-vinyl acetate copolymer (Trademark "VYHH", made by Union Carbide Japan K.K.) | 40 |
| Tetrahydrofuran | 150 |
| Toluene | 15 |

The above prepared recording layer coating liquid was coated on a polyester film with a thickness of about 100 μm, serving as a support, and dried, so that a recording layer with a thickness of about 7 μm was formed on the support.

Formation of Protective Layer

The following components were mixed to prepare a protective layer coating liquid:

| | Parts by Weight |
|---|---|
| 75% butyl acetate solution of urethane-acrylate-based ultraviolet curing resin (Trademark "Unidic C7-157" made by Dainippon Ink & Chemicals, Incorporated) | 10 |
| Toluene | 10 |

The above prepared protective layer coating liquid was coated on the above formed recording layer, dried, and and exposed to an ultraviolet lamp for UV curing, so that a protective layer made of a UV cured resin with a thickness of about 2 μm was formed on the recording layer. Thus, a reversible thermosensitive recording medium No. 2 for use in the present invention was obtained.

This reversible thermosensitive recording medium becomes transparent at a first specific temperature range from about 70° C. to 100° C., and becomes white opaque at a second specific temperature range above about 100° C.

White opaque images were formed on this reversible thermosensitive recording medium under the same conditions in Example 1 except that the voltage applied to the thermal head for the formation of the white opaque images was changed from 29 V to 27.5 V.

The thus formed white opaque images were erased by making them transparent by a heat roller. This image formation and image erasure cycle was repeated 500 times. During the 500 cycles of the image formation and image erasure, the temperature of the heat roller was raised to a temperature above the image formation temperature for the recording medium one time per 10 cycles.

The weight of the heat roller on the recording medium was 200 g, and the weight applied area was about 5 $cm^2$, and the maximum pressure applied to the recording medium was not more than 150 $g/cm^2$.

The recording medium was transported at a speed of 3 cm per second, and the contact time of the recording medium with the heat roller was about 0.1 second.

The changes in the image density during the above-mentioned repeated image formation and image erasure are shown in Table 3.

EXAMPLE 16

The procedure for Example 15 was repeated except that during the 500 cycles of the image formation and image erasure, the reversible thermosensitive recording medium was heated by hot air to a temperature above the image formation temperature for the recording medium one time per 10 cycles.

The changes in the image density during the above-mentioned repeated image formation and image erasure are shown in Table 3.

EXAMPLE 17

White opaque images were formed on the reversible thermosensitive recording medium employed in Example 15 in the same manner as in Example 15 by use of the thermal head. The recording medium was then heated by hot air to a temperature above the image formation. The white opaque images were then made transparent by the heat roller employed in Example 15. This image formation and image erasure cycle was repeated 500 times.

The changes in the image density during the above-mentioned repeated image formation and image erasure are shown in Table 3.

TABLE 3

| | White Opaque Density | | | |
|---|---|---|---|---|
| | 1st Cycle | 10th Cycle | 100th Cycle | 500th Cycle |
| Example 15 | 0.56 | 0.55 | 0.56 | 0.57 |
| Example 16 | 0.56 | 0.57 | 0.57 | 0.60 |
| Example 17 | 0.56 | 0.55 | 0.56 | 0.62 |

What is claimed is:

1. A method of compensating for distortion in a recording layer of a reversible thermosensitive recording medium, the transparency of said recording layer being changeable depending upon the temperature thereof, and said recording layer being capable of forming images and erasing said images reversibly, said distortion in said recording layer being caused by the repeated image formation by image formation means and/or image erasure by image erasing means, comprising the step of applying stress to said recording layer before and/or after image formation by moving said recording medium relative to said image formation means, in a direction different from the direction of the application of stress in the course of a previous image formation or image erasure, thereby compensating for the distortion, wherein said recording layer comprises: (a) an organic low-molecular-weight material and a resin matrix in which the organic low-molecular-weight material is dispersed; or (b) a leuco dye.

2. The method of compensating for the distortion in the recording layer of the reversible thermosensitive recording medium as claimed in claim 1, wherein said stress applied to said recording layer for compensating for the distortion therein is applied by a pressure application means, and at the same time, said recording medium is moved in a direction opposite to the direction in which said recording medium is transported during image formation.

3. The method of compensating for the distortion in the recording layer of the reversible thermosensitive recording medium as claimed in claim 2, wherein said image erasing means also serves as said pressure application means.

4. The method of compensating for the distortion in the recording layer of the reversible thermosensitive recording medium as claimed in claim 2, wherein said image formation means and said image erasing means are one and the same, and also serve as said pressure application means.

5. The method of compensating for the distortion in the recording layer of the reversible thermosensitive recording medium as claimed in claim 2, wherein said pressure application means applies said stress by the application of a pressure of about 0.1 $kg/cm^2$ or more.

6. The method of compensating for the distortion in the recording layer of the reversible thermosensitive recording medium as claimed in claim 1, wherein said image formation means and said image erasing means separately serve as pressure application means for applying pressure to said recording layer of said recording medium.

7. The method of compensating for the distortion in the recording layer of the reversible thermosensitive recording medium as claimed in claim 6, wherein said pressure application means has a heat application function and applies heat to said recording layer of said recording medium during the application of pressure to said recording layer.

8. The method of compensating for the distortion in the recording layer of the reversible thermosensitive recording medium as claimed in claim 6, wherein said pressure application means applies pressure to said recording layer of said recording medium between the repetition of image formation and/or image erasure.

9. A method of compensating for distortion in a recording layer of a reversible thermosensitive recording medium; the transparency of said recording layer being changeable, depending upon the temperature thereof, and said recording layer being capable of forming images and erasing said images reversibly, said distortion in said recording layer being caused by the repeated image formation by image formation means and/or image erasure by image erasing means, comprising the step of applying heat to said recording layer by a non-contact heat application means before and/or after image formation by moving said recording medium relative to said image formation means, wherein said recording layer comprises: (a) an organic low-molecular-weight material and a resin matrix in which the organic low-molecular-weight material is dispersed; or (b) a leuco dye.

10. The method of compensating for the distortion in the recording layer of the reversible thermosensitive recording medium as claimed in claim 9, wherein said non-contact heat application means serves as said image erasing means.

11. The method of compensating for the distortion in the recording layer of the reversible thermosensitive recording medium as claimed in claim 9, wherein the duration of heat application by said said non-contact heat application means is not less than about 0.2 seconds.

12. A method of compensating for distortion in a recording layer of a reversible thermosensitive recording medium, the transparency of said recording being changeable depending upon the temperature thereof, and said recording layer being capable of forming images and erasing said images reversibly, said distortion in said recording layer being caused by the repeated image formation by image formation means and/or image erasure by image erasing means, comprising the step of changing the transporting direction of said recording medium before and/or after image formation by moving said recording medium relative to said image formation means, thereby compensating for the distortion, whereby said recording layer comprises: (a) an organic low-molecular-weight material and a resin matrix in which the organic low-molecular-weight material is dispersed; or (b) a leuco dye.

13. The method of compensating for the distortion in the recording layer of the reversible thermosensitive recording medium as claimed in claim 12, wherein the changing the transporting direction of said recording medium is conducted during the formation of one picture element in said image formation.

14. The method of compensating for the distortion in the recording layer of the reversible thermosensitive recording medium as claimed in claim 13, wherein the changing of the transporting direction of said recording medium is conducted intermittently, and energy application is carried out by printing pulses during the movement of said recording medium.

* * * * *

UNITED STATES PATENT AND TRADEMARK OFFICE

CERTIFICATE OF CORRECTION

PATENT NO. : 5,310,718

DATED : May 10, 1994

INVENTOR(S) : Tetsuya AMANO et al.

It is certified that error appears in the above-indentified patent and that said Letters Patent is hereby corrected as shown below:

In column 3, line 12, change "unit for" to --unit--;

line 31, change "behind the" to --behind--;

line 68, change "in" to --.--.

In column 4, line 2, delete "by".

In column 5, line 10-11, change "D through D" to --B through D--.

In column 7, line 14, change "matrix resin" to --matrix--;

line 43, change "vlnyl" to --vinyl--.

In column 15, line 3, change "the stress" to --stress-;

line 34, after "repeated" insert --.--.

In column 16, line 58, after "can" insert --be--.

In column 17, line 29, after "application" insert --can--.

In column 20, line 61, change "and the" to --and--;

line 65, change "become" to --becomes--.

UNITED STATES PATENT AND TRADEMARK OFFICE

CERTIFICATE OF CORRECTION

PATENT NO. :5,310,718

DATED :May 10, 1994

INVENTOR(S) :Tetsuya AMANO et al.

It is certified that error appears in the above-indentified patent and that said Letters Patent is hereby corrected as shown below:

In column 22, line 8, change "using of" to --using--;

line 27, change "opque" to --opaque--.

In column 25, line 65, change "and exposed" to --exposed--.

In column 26, line 22, change "weight applied area was" to --weight was applied to an area of--.

In column 28, line 5, change ";" to --,--;

line 6, change "changeable," to --changeable--;

line 44, change "whereby" to --wherein--.

Signed and Sealed this

Eighteenth Day of July, 1995

*Attest:*

*Attesting Officer*

BRUCE LEHMAN

*Commissioner of Patents and Trademarks*